US006945885B2

(12) United States Patent
Snider

(10) Patent No.: US 6,945,885 B2
(45) Date of Patent: Sep. 20, 2005

(54) ARTICULATED FOOTBALL GOAL POST

(76) Inventor: James L. Snider, 122 Allison Ave., Bridgeport, WV (US) 26330

( * ) Notice: Subject to any disclaimer, the term of this patent is extended or adjusted under 35 U.S.C. 154(b) by 0 days.

(21) Appl. No.: 10/779,833

(22) Filed: Feb. 17, 2004

(65) Prior Publication Data

US 2004/0166968 A1 Aug. 26, 2004

Related U.S. Application Data

(60) Provisional application No. 60/449,480, filed on Feb. 21, 2003.

(51) Int. Cl.[7] ..... A63B 63/00
(52) U.S. Cl. ..... 473/477
(58) Field of Search ..... 473/488, 485, 473/486, 479, 484, 476, 472, 415, 477

(56) References Cited

U.S. PATENT DOCUMENTS 2,819,547 A * 1/1958 Clements, Jr. ..... 40/612
2,884,252 A 4/1959 Thompson
3,018,102 A * 1/1962 Murphy ..... 473/481
3,516,666 A * 6/1970 Rottman et al. ..... 473/477
3,856,302 A * 12/1974 Karkoska ..... 473/477
3,908,992 A 9/1975 Cunningham et al.
3,981,501 A * 9/1976 Gonzalez et al. ..... 473/477
4,026,554 A 5/1977 Karkoska
4,412,679 A * 11/1983 Mahoney et al. ..... 473/483
4,465,277 A * 8/1984 Dittrich ..... 473/447
4,801,142 A * 1/1989 Friesen ..... 473/484
5,601,284 A * 2/1997 Blackwell et al. ..... 473/483
5,738,601 A 4/1998 Hughes
5,839,980 A 11/1998 Kendy
6,261,196 B1 7/2001 Caruso
6,302,811 B1 10/2001 Topham
6,394,917 B1 5/2002 Chiappini et al.
6,402,644 B2 * 6/2002 Stanford et al. ..... 473/484

* cited by examiner

*Primary Examiner*—Gregory Vidovich
*Assistant Examiner*—M. Chambers
(74) *Attorney, Agent, or Firm*—William L. Krayer

(57) ABSTRACT

An articulated football goal post can be raised to a high position and a low position relative to the game position, for safety and security, and to facilitate the attachment of television cameras and the like. The crossbar and uprights are supported on the end of a boom pivoted on a vertical column and powered by a hydraulic jack, which may be operated remotely. Through either a parallel linkage or a separate hydraulic jack, the uprights are held in a substantially vertical orientation throughout the pivoting motion.

13 Claims, 10 Drawing Sheets

ARTICULATED FOOTBALL GOAL POST

RELATED APPLICATION

This application claims the full benefit of my Provisional Application 60/449,480 filed Feb. 21, 2003, titled "Hydraulically Actuated Football Goal Post," which is incorporated herein by reference in its entirety.

FIELD OF THE INVENTION

The invention relates to football goal posts, particularly to a goal post that can be adjusted in height and otherwise manipulated for improved safety and security, and readily placed in condition for use according to standard rules.

BACKGROUND OF THE INVENTION

Rabid and out-of-control spectators and/or students at many football and other sporting events have frequently surged onto the field to destroy or topple the goal posts, presenting serious threats to human life, physical injuries, damage to and destruction of property, theft, and great expense in repairing and replacing the goal posts. Many presently existing goal posts are not easily removed or damaged, but some spectators have proven determined and innovative in carrying out their objective of destruction, sometimes bringing ropes, ladders and other equipment to aid in their endeavors.

A football goal is essentially a horizontal pipe or rod important only for extra points and field goals, not necessary for a touchdown. The horizontal rod or crosspiece must, by rule, be in a certain location and has flanking uprights so the officials can readily see whether a kick passes over it. But the support for the structure can be dangerous to the players as it normally is located near the action of the game.

There is a need for a goal and/or goal post that can safely manipulate the crosspiece to avoid damage by spectators and others, as well as to avoid injury to persons present when a mob is intent on damaging the goal. There is a need also for a goal that can be easily moved from the field for storage, as in the case of a multi-use stadium. And, there is a need for a goal structure that reduces the possibility of players colliding with it and sustaining injuries.

SUMMARY OF THE INVENTION

My invention provides a cross member for a goal post which can be hydraulically elevated to a position well beyond the reach of most vandals and others intent on destruction. The goal can be readily lowered as well, permitting the easy installation and maintenance of television cameras and the like. Manipulation of the goal is accomplished from a remote control panel. The crossbar is supported preferably on a heavy steel upright that can optionally be placed farther back from the field than is commonly the case. The entire assembly can be removed from the field for storage.

The structure comprises a vertical column, a main boom, a nose boom, and a goal element including a crossbar and uprights on the ends of the crossbar. The structure is articulated at both ends of the main boom. During raising and lowering, the nose boom is caused to remain horizontal, so that the uprights on the ends of the crossbar remain vertical. The vertical column is bolted to a concrete base during use.

DETAILED DESCRIPTION OF THE INVENTION

Figure 1A:
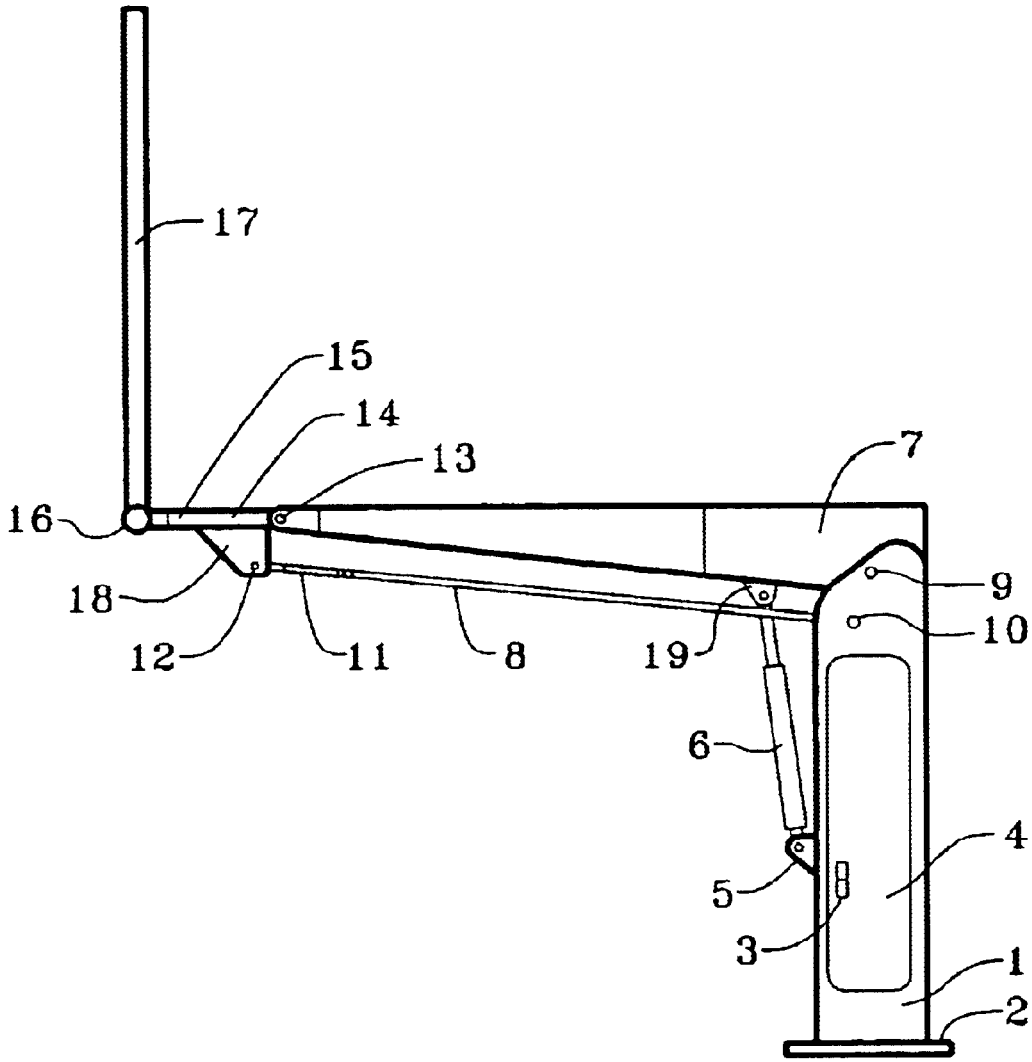
FIG. 1*a* is a side elevational view and FIG. 1*b* is a perspective view of my new goal post, in standard position ready for play
Figure 1B:
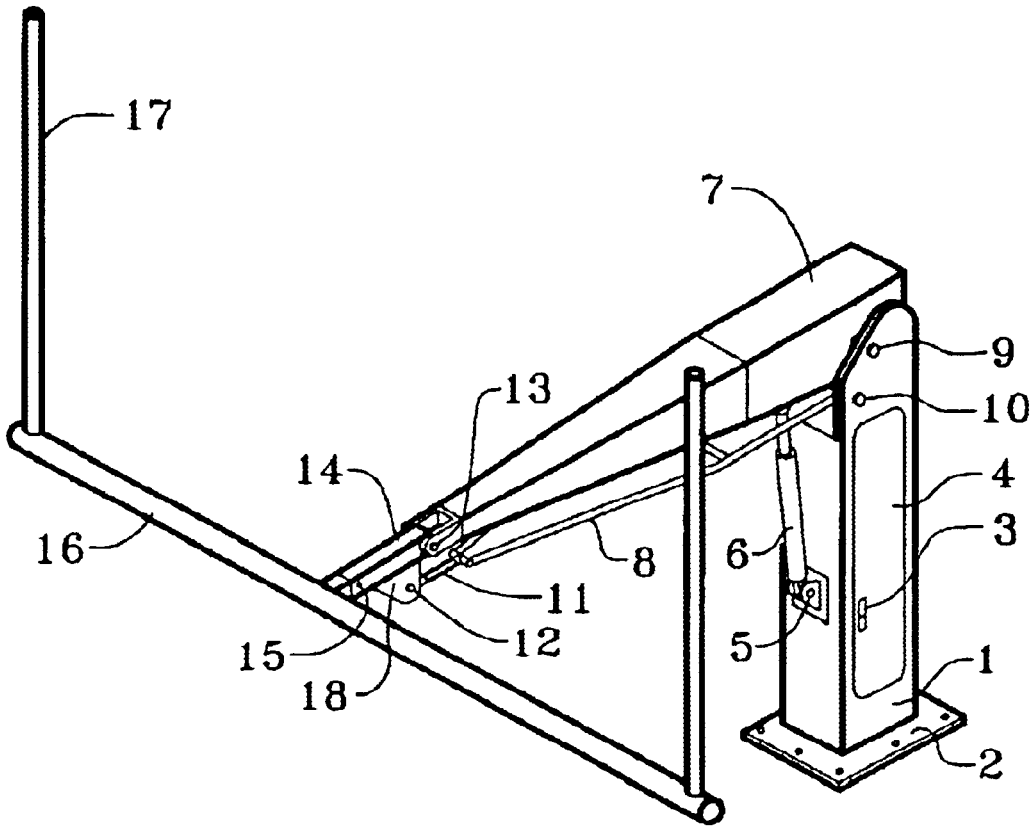

Referring first to FIGS. 1*a* and 1*b*, the vertical column 1 rests on base plate 2, which is bolted to a concrete substructure not shown. Vertical column 1 may be fabricated from 4 pieces of ⅜" mild steel forming the main vertical box structure welded to the base plate 2. Base plate 2 may have, for example, 8¾ inch holes designed for installation of bolts to provide a mechanical, removable connection between the vertical column 1 and the substructure, permitting complete removal of the apparatus from the field. Main boom 7 (sometimes called an arm herein), which may be made of a lighter metal such as aluminum, is connected to the vertical column 1 at pivot 9. Nose boom 14 is connected to main boom 7 through a pivot 13. Beneath nose boom 14 is upper control arm bracket 18. Upper control arm bracket 18 is fixed to nose boom 14 and connected through pivot 12 to control arm 8.

Control arm 8 is adjustable in length by a threaded insert 11. Adjustment of the length of control arm 8 enables adjustment or correction of the vertical orientation of uprights 17 on the ends of crossbar 16. Crossbar 16 is fixed to nose boom 14 through removable pin 15, permitting disassembly of the crossbar from the rest of the structure. Control arm 8 is connected to the vertical column 1 at pivot 10. Hydraulic jack 6 is pivoted and fixed to the vertical column 1 at lower mount 5 and pivoted and fixed to main boom 7 at upper mount 19. Vertical column 1 includes an access door 4 for the hydraulic pump, pump motor and other devices for operating the structure, which will be described in more detail with respect to FIG. 6. Access door 4 has a lockable latch 3.

Crossbar 16 may have nipples or vertical extensions, not shown, for insertion into uprights 17 so they may be easily attached or removed. The uprights 17 may be attached to crossbar 16 in any known acceptable manner. Both the crossbar 16 and uprights 17 may be made preferably of a light metal, but any substantially rigid material will suffice. Whether or not the uprights 17 are tubular, they may be adapted for insertion or attachment, at their upper ends, for wind direction indicators or other devices.

Figure 2A:
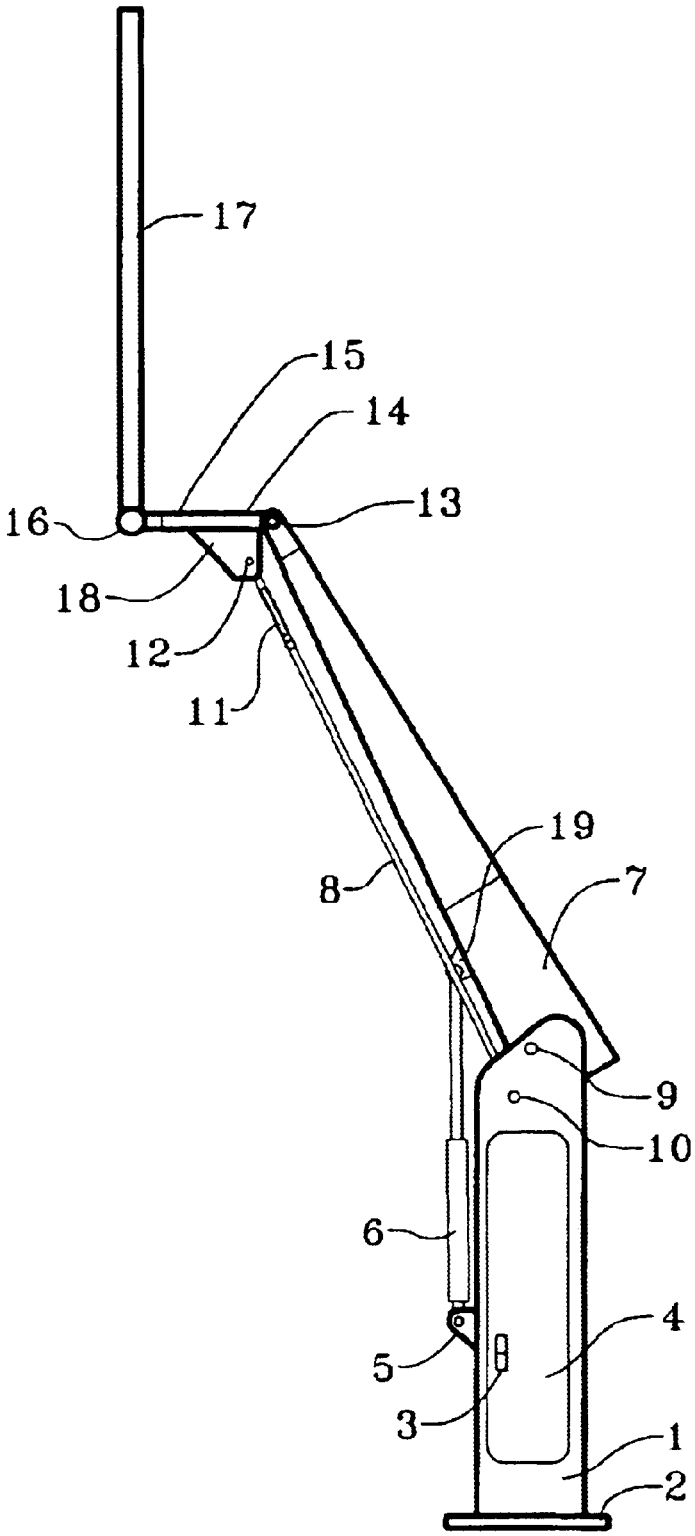
FIGS. 2*a* and 2*b* show the goal in the elevated position.
Figure 2B:
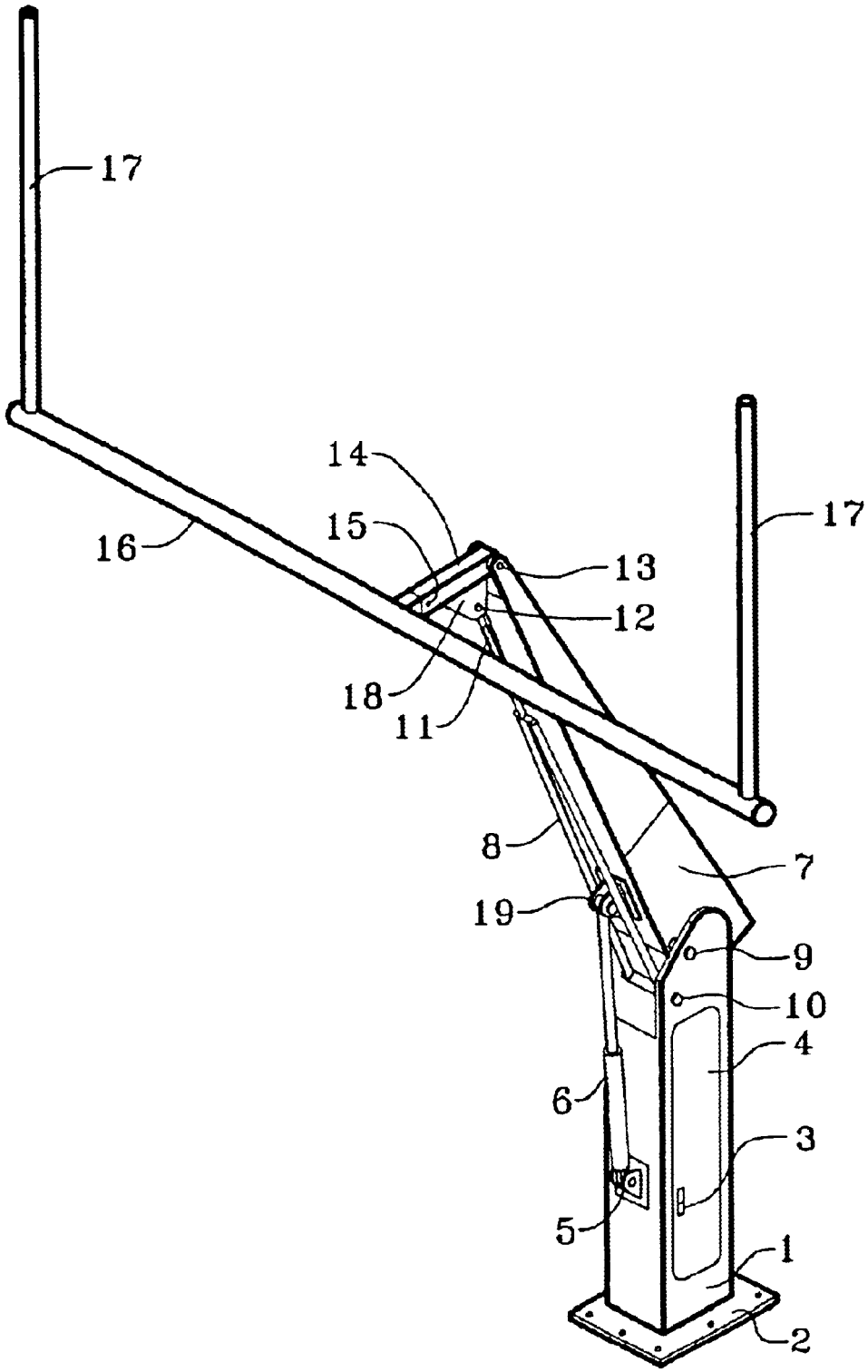

In FIGS. 2*a* and 2*b*, the goal is in the elevated position. In this depiction of the invention, main boom 7 is at an angle about 60 degrees from the horizontal. A particular feature of the invention is that the nose boom 15 is maintained horizontal, so that uprights 17 are maintained in a vertical orientation. It will be observed that control arm 8 is maintained at a constant length and accordingly pivot 12 moves in a substantially circular arc as main boom 7 is elevated, while control arm 8 is also held substantially parallel to main boom 7, resulting in nose boom 14 being held substantially horizontal throughout the elevation of main boom 7 from its generally horizontal orientation of FIGS. 1*a* and 1*b*. A major purpose of elevating the crossbar is to move it far out of the reach of a persons intent on damaging it. Accordingly, the apparatus should be capable of moving the crossbar to a height of at least fifteen feet; I prefer seventeen feet or more.

Figure 3A:
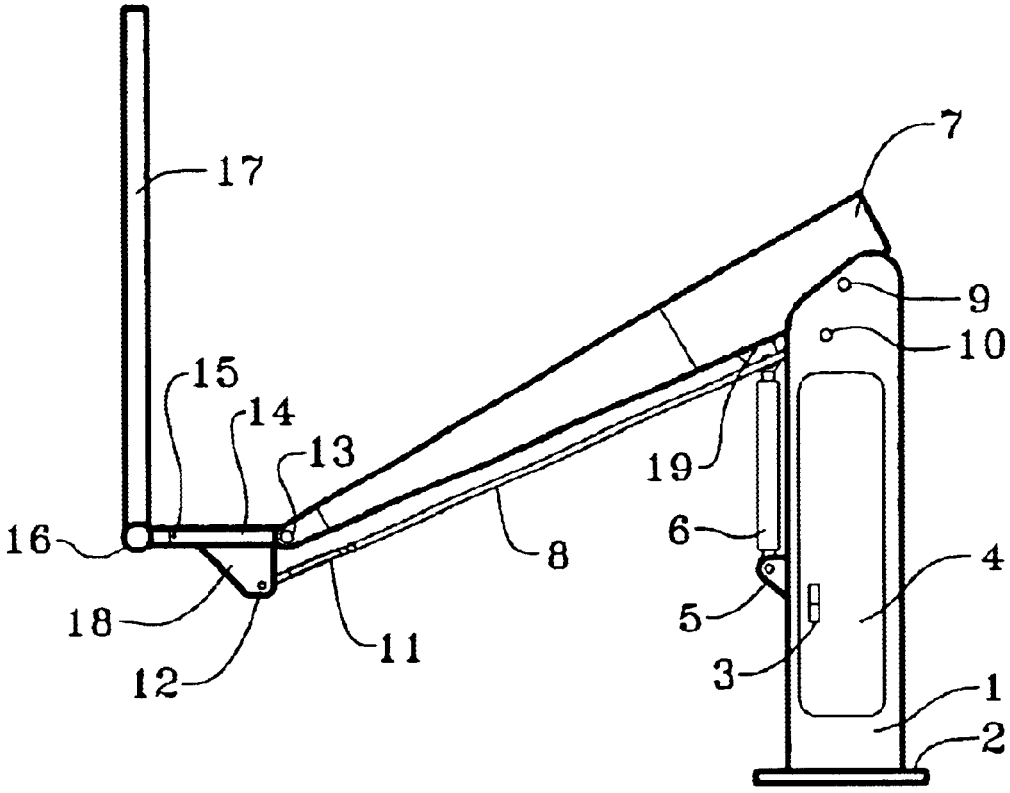
FIGS. 3*a* and 3*b* show the goal in the lowered position.
Figure 3B:
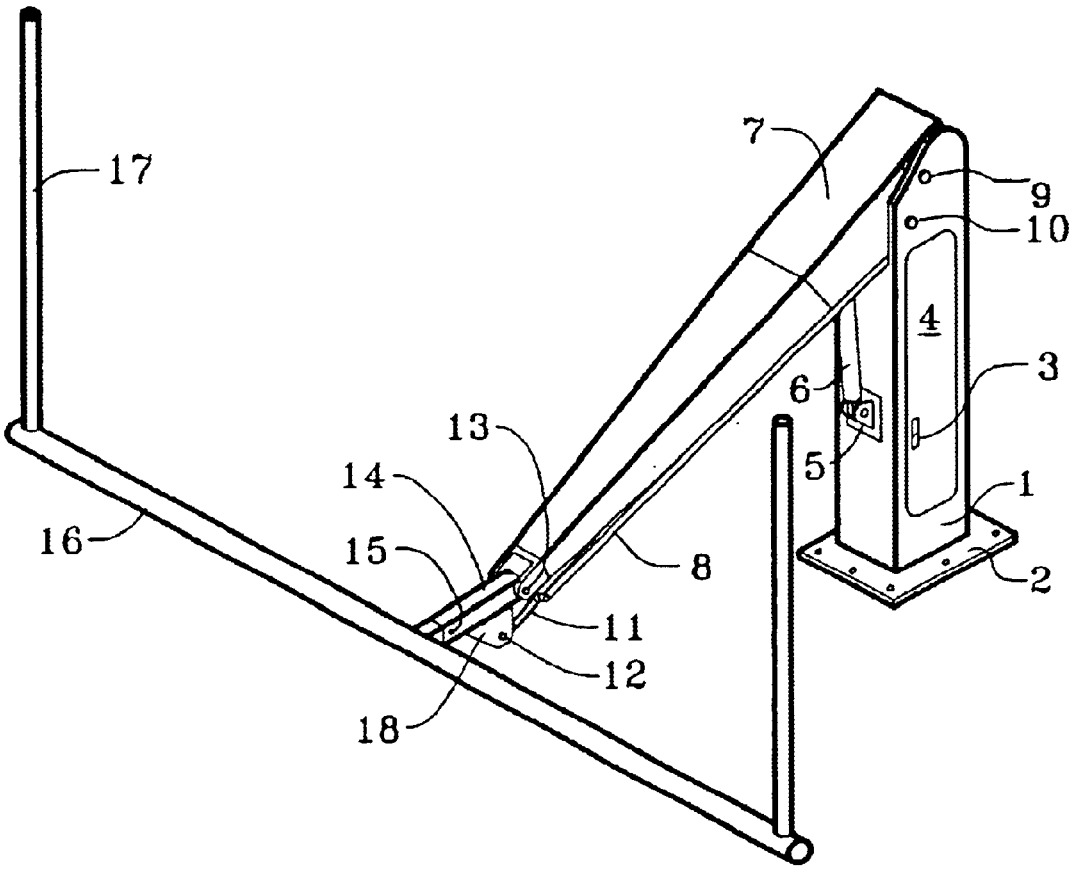

Referring now to FIGS. 3*a* and 3*b*, the apparatus is seen to be in the lowered position, main boom 7 having been lowered from the horizontal about 30 degrees. It should be observed that the hydraulic jack 6 is approximately parallel to vertical column 1, whereas it is angled slightly away from vertical column 1 in FIGS. 1*a* and 1*b*. When the apparatus is in the elevated position as shown in FIGS. 2*a* and 2*b*, hydraulic jack 6 is still slightly angled from vertical column 1, but not as much as when the apparatus is in the playing mode as in FIGS. 1*a* and 1*b*. In FIGS. 3*a* and 3*b*, the uprights remain vertical and nose boom 14 is horizontal, no adjustment being necessary in the length of control arm 8 because of the movement from fully elevated (as in FIGS. 2*a* and 2*b*) to completely lowered, as in FIGS. 3*a* and 3*b*.

Figure 4:
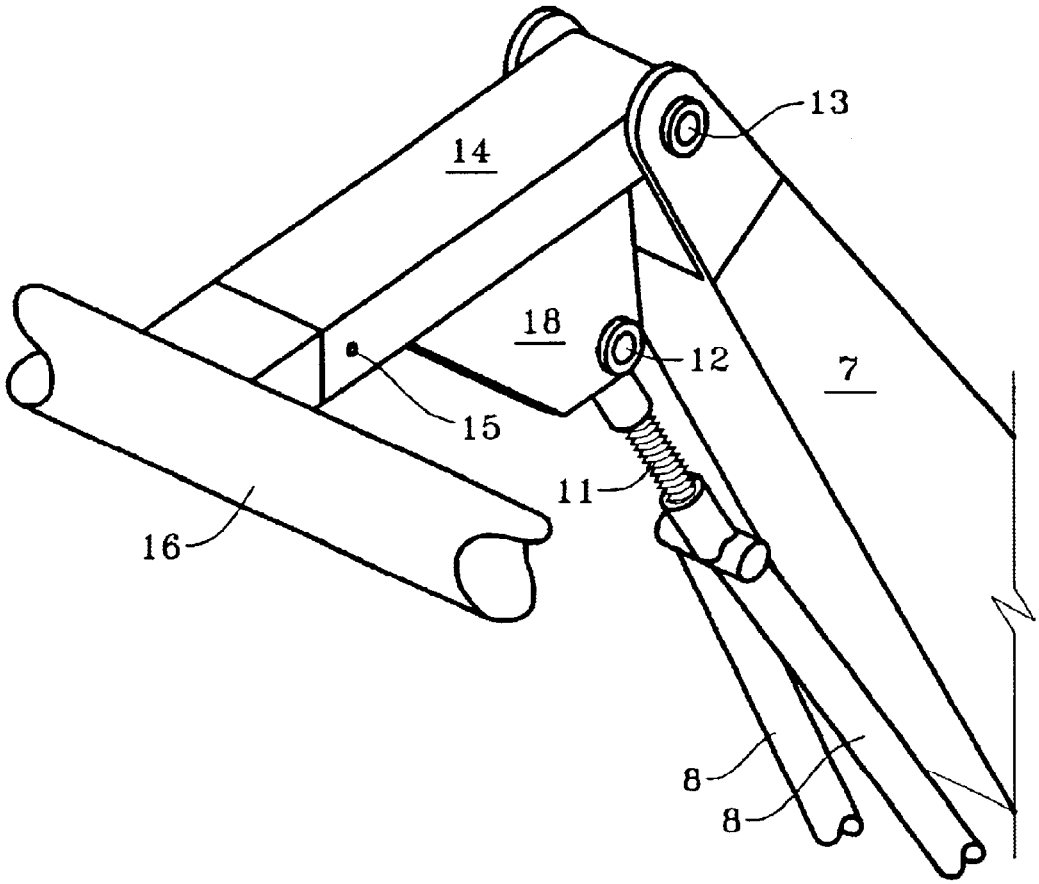
FIG. 4 is a detailed view of the nose boom assembly.

In FIG. 4, the nose boom 14 and associated parts are shown in detail. Pin 15 can be removed to separate the crossbar 16 from nose boom 14. Pivot 13, connecting main boom 7 and nose boom 14, together with pivot 12, connecting upper control arm bracket 18 and control arm 8, assures that nose boom 14 will be held substantially horizontal throughout the manipulation of the apparatus. If there is a slight deviation from the horizontal (which is readily detectable because the uprights 17 will not be vertical), an adjustment in the effective length of control arm 8 can be made by turning threaded insert 11 in one direction or the other. When the length of control arm 8 is coordinated with the effective length of main boom 7 (the distance between pivots 13 and 9), it can automatically assure that the nose boom 14 will remain horizontal and the uprights 17 are vertical regardless of the angular position of the main boom 7.

Since neither the elevated position nor the lowered position of the apparatus is normally used in the game, it may not be considered essential that the nose beam 7 remain strictly horizontal in those positions nor that the uprights extend exactly vertical; accordingly perhaps the only position for which some users may adjust threaded insert 11 will be the playing position shown in FIGS. 1*a* and 1*b*. But because of the positioning and close relationship of main boom 7 and control arm 8, an adjustment of the nose boom 14 to make it horizontal in the playing position will more or less automatically adjust the elevated and lowered positions also so that the nose boom 14 will be horizontal and the uprights 17 vertical.

Figure 5:
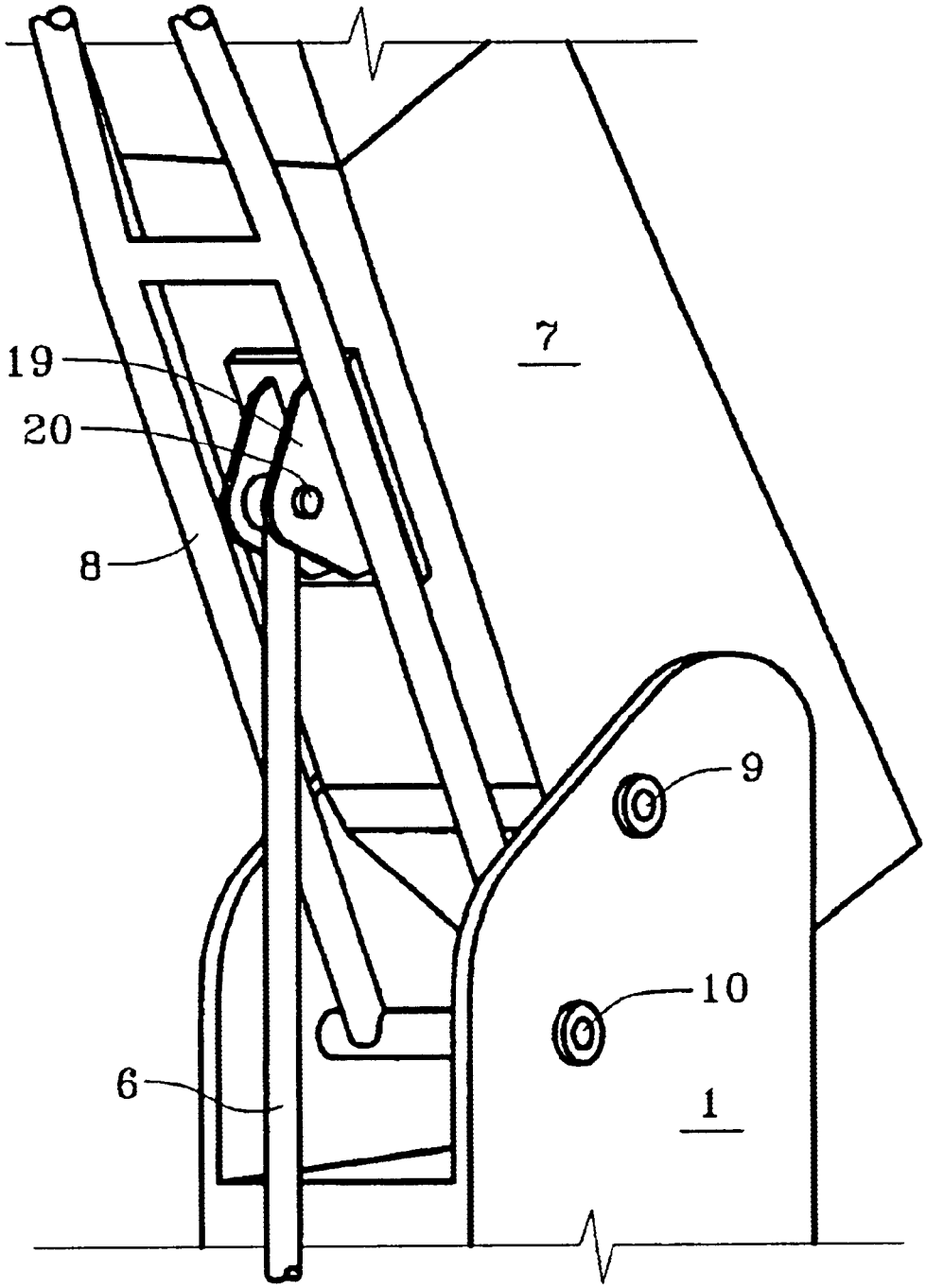
FIG. 5 details a hydraulic jack connection to the main boom.

The detail of FIG. 5 shows the articulation of main boom 7 in closeup fashion. Hydraulic jack 6 is connected at pivot 20 on upper mount 19, which is fixed to the main boom 7. Control arm 8 is situated on pivot 10 in vertical column 1. Also on vertical column 1 is pivot 9 for the main boom 7. The main boom 7 is elevated in this view, and accordingly if it were to be lowered to either the play or lowered position, hydraulic jack 6 would be retracted, pivoting on pivot 20, causing the main boom 7 to be pivoted downwardly on pivot 9 and also causing control arm 8 to be pivoted on pivot 10. The effective distances between pivots 9 and 10, and 12 and 13, are approximately equal, as are the effective distances between pivots 9 and 13 and pivots 12 and 10. This double pivoting relationship thus forms an approximate parallelogram with the four pivots as corners, which assures that the nose beam remains horizontal throughout any manipulation of the main boom 7.

Figure 6:
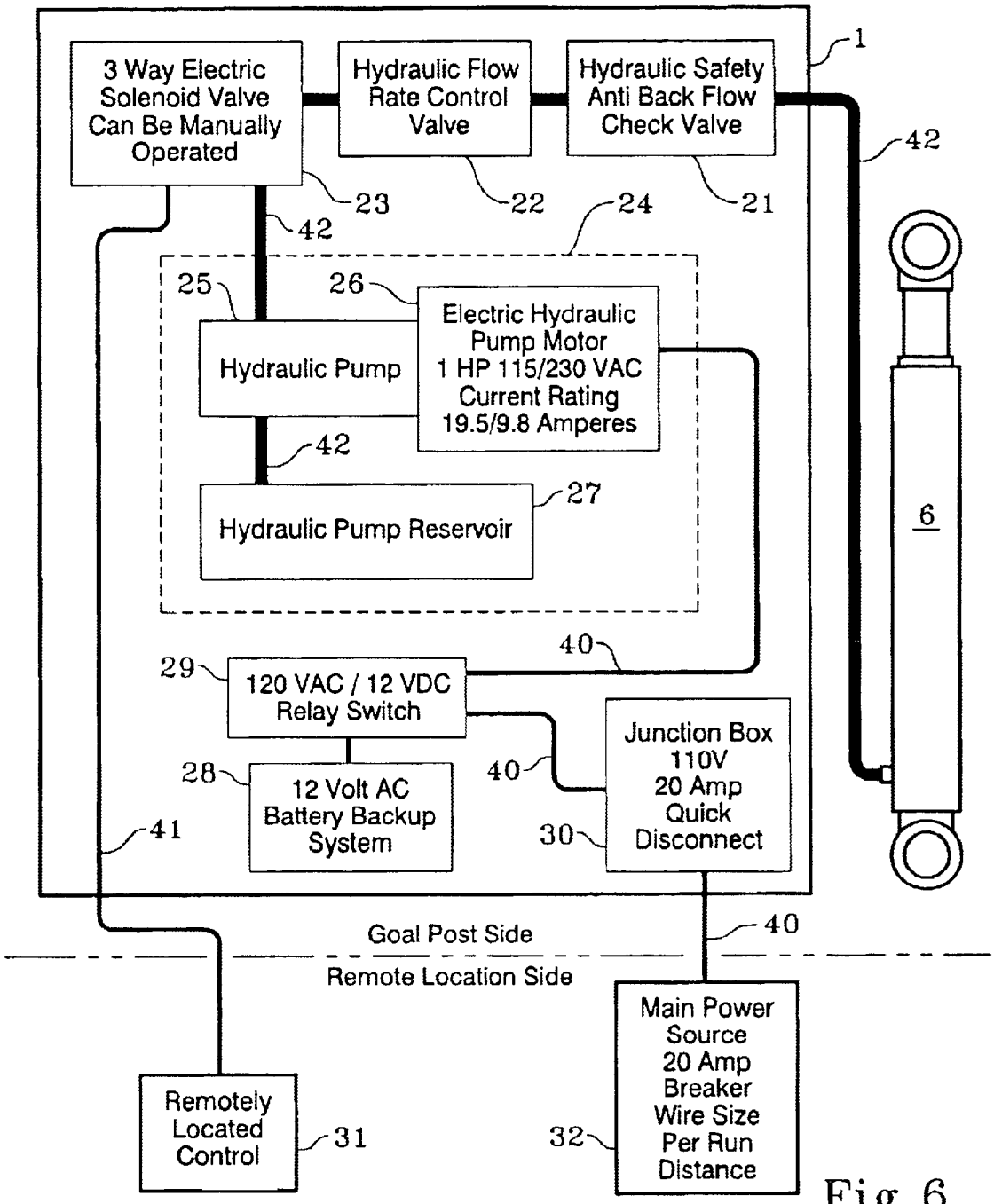
FIG. 6 is a schematic of the electrical and hydraulic systems.

The more or less diagrammatic FIG. 6 shows some power lines 40, electrical control connections 41, and hydraulic fluid lines 42. Hydraulic jack 6 is extended or retracted according to the direction of flow of hydraulic fluid, which in turn is determined by a remotely located hydraulic controller 31, normally operated by a human being. The reversible hydraulic pump 25, its associated electric pump motor 26, and the hydraulic fluid reservoir 27 are all located within the vertical column 1, designated here as 24, usually also together with a power junction box 30, receiving AC power from an external source 32, a battery backup 28, and a relay switch 29 for switching from AC to DC in an emergency, i.e. if the external power source is cut or otherwise becomes unavailable. A check valve 21 may be used to guard against sudden interruption of power, or pressure loss. The controller 31 is able to command the pump. Wires connecting controller 31 to the electric motor 26 and three-way solenoid valve 23 should pass underground to the field operator's location remote from the goal. Design and construction of the concrete substructure mentioned in connection with FIGS. 1*a* and 1*b* should provide a utility channel leading to the desired remote location for power source 32 and controller 31. Ideally, the controller will have only three simple options—play, elevated, and lowered. The operator normally needs only to choose one of the three options and the control system will operate the hydraulic jack 6 accordingly. The controller may use a wireless system to communicate with the pump motor and/or other devices within vertical column 1.

Persons skilled in the art will recognize that any conventional hydraulic fluid may be used—that is, no special fluid is required, although of course it should have a low freezing point where freezing conditions may be expected. The system may be pneumatic—that is, the fluid may be air. As used herein, the terms "hydraulic" and "hydraulic fluid" means any fluid suitable for use in a positioning cylinder or other actuator such as hydraulic jack 6. Alternatively, the motion of main boom 7 may be accomplished by mechanical means through gears or other leverage applied directly from an electric motor, such as an electric actuator. Any suitable device for applying force to cause main boom 7 to pivot on pivot 20 may be satisfactory; such a device—that is, the means for moving the main boom and, sometimes separately, the nose boom, may be referred to herein broadly as an actuator.

It also may be observed that the nose boom is not essential if one is not concerned about the orientation of the uprights 17 as the apparatus is moved from the playing mode to the lowered or elevated mode. Also, it is not essential that the vertical column 1 be exactly vertical in orientation—it may "lean" either forward or backward, or may take the form of a pyramid or other support. My use of the term "vertical column" is intended to include any support that is capable of supporting the main boom 7 at a pivot 9. For example, one might, for whatever reason, wish to support the pivot 9 on a structure having two legs and a horizontal member with a bracket for holding pivot 9. Such a structure would be functionally and structurally equivalent to the vertical column illustrated herein and accordingly is intended to be included within the meaning of "vertical column." For my purposes, the pivot 9 will normally be at a height of about the same height as a regulation crossbar, or somewhat lower as is evident in FIG. 1*a*; this may be varied somewhat within the scope of my invention.

Figure 7:
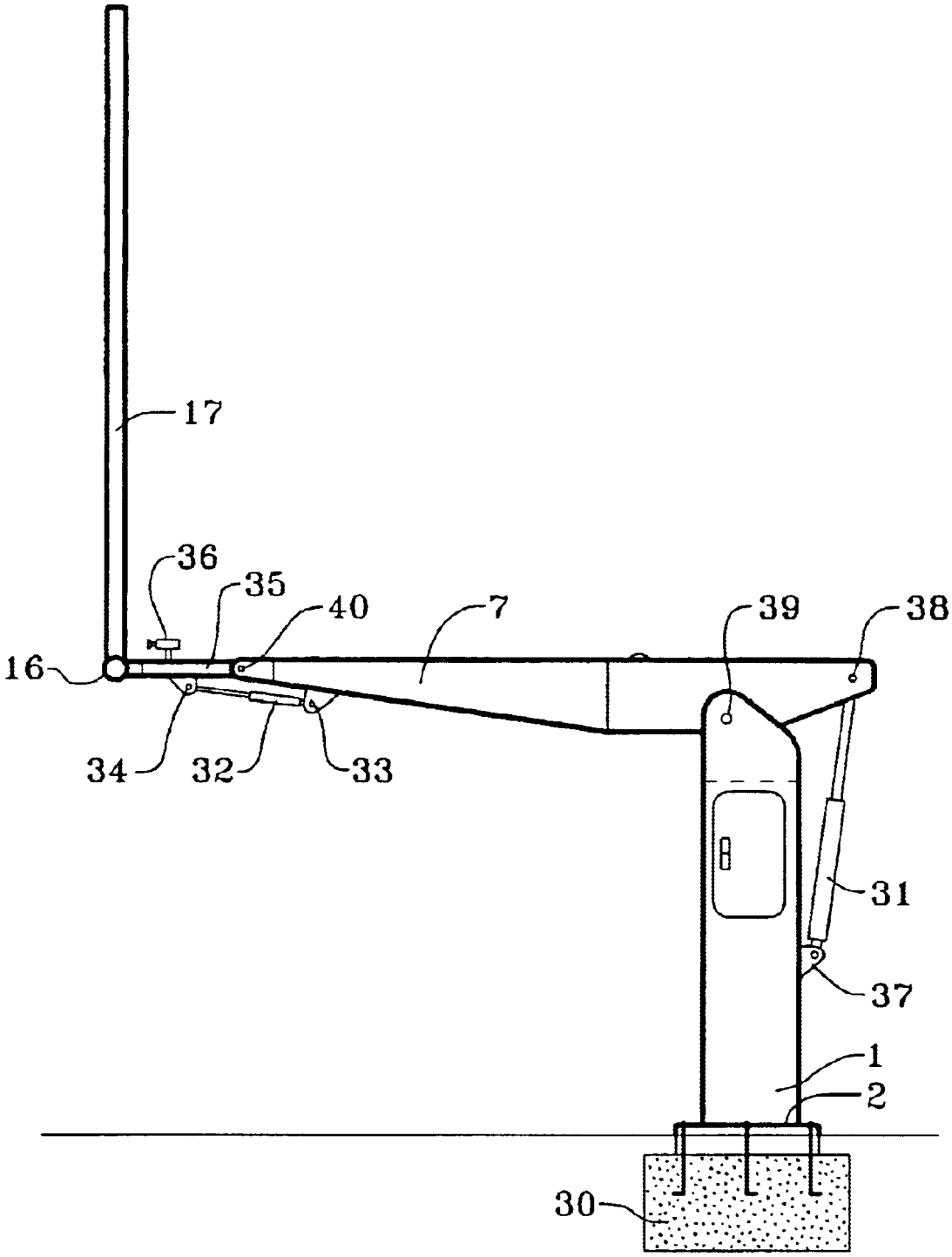
FIG. 7 shows an alternate position for the hydraulic jack.

FIG. 7 shows an alternate configuration in which the hydraulic jack 31 is on the side of vertical column 1 opposite that of FIG. 1*a*, and pivot 38 on main boom 7 is leveraged somewhat differently from that of FIG. 1*a*. Hydraulic jack 31 pivots on pivot 37 and pivot 38 ; main boom 7 pivots on pivots 38 and 39, which is located on vertical column 1. In this illustration, it will be seen that there is no control arm 8, but there is a second hydraulic jack 32 connecting nose boom 35 with main boom 7. In the variation of FIG. 7, if one desires to maintain nose boom 35 horizontal at all times, it is necessary to coordinate the action of hydraulic jack 32 with that of hydraulic jack 31. If main boom 7 is elevated, hydraulic jack 32 will be retracted, and if main boom 7 is lowered, hydraulic jack 32 will be extended to assure that nose boom 35 remains horizontal. The controller in such a system will have somewhat more complexity than those of FIGS. 1–5, and a separate hydraulic line should be supplied to hydraulic jack 32.

Therefore, it may be understood that my invention includes an articulating goal post for a football field comprising (a) a vertical column, (b) an arm pivoted thereon (c) a crosspiece near the end of the arm, and (d) upright members attached to the ends of the crosspiece. In another aspect, my invention includes a goal post comprising a vertical column having a base, a pivoted arm thereon, a crosspiece near the end of the pivoted arm, and two upright members, the upright members and the crosspiece defining a regulation kicking goal when the goal post is in a playing position, and means for moving the crosspiece and the upright members by the pivoted arm to an elevated position wherein the crosspiece is at least fifteen feet above the base. In yet another aspect, my invention is a football goal post comprising a crossbar, upright members on the ends of the crossbar, a nose boom rigidly connected to the crossbar, a main boom having a forward end and a rear end, the main boom being pivotally connected to the nose boom at the forward end, a vertical column including a pivot connecting the rear end of the main boom to the vertical column, a hydraulic jack pivotally mounted on the vertical column and pivotally connected to the main boom, and a substantially rigid control arm pivotally connecting the nose boom and the vertical column. My invention may be otherwise varied within the scope of the following claims.

What is claimed is:

1. A goal post comprising a vertical column having a base, a pivoted arm thereon, a crosspiece near the end of said pivoted arm, and two upright members on the ends of said crosspiece, said upright members and said crosspiece defining a regulation kicking goal when said goal post is in a playing position, with said upright members in a substantially upright vertical orientation, and means for moving said crosspiece and said upright members by said pivoted arm to an elevated position wherein said crosspiece is at least fifteen feet above said base and higher than said crosspiece in said playing position and said upright members are in a substantially vertical upright orientation.

2. The goal post of claim 1 including means for moving said crosspiece to a lowered position no higher than seven feet from said base.

3. The goal post of claim 1 including articulating means for moving said crosspiece near and said crosspiece.

4. A goal post of any of claim 1 having a viewing device thereon.

5. A goal post of claim 1 wherein said means for moving include a hydraulic cylinder.

6. A football goal post comprising a crossbar, upright members on the ends of said crossbar, a nose boom rigidly connected to said crossbar, a main boom having a forward end and a rear end, said main boom being pivotally connected to said nose boom at said forward end, a vertical column including a pivot connecting said rear end of said main boom to said vertical column, an actuator pivotally mounted on said vertical column and pivotally connected to said main boom, and a substantially rigid control arm pivotally connecting said nose boom and said vertical column.

7. A football goal post of claim 6 wherein said substantially rigid control arm is adjustable in length.

8. A football goal post of claim 6 wherein said substantially rigid control arm is connected to said nose boom and said vertical column at pivot points chosen so that said upright members will remain in a substantially upright orientation during pivoting of said main boom.

9. A football goal post of claim 8 wherein said pivot points are related in position as the corners of a parallelogram.

10. A football goal post of claim 6 wherein said actuator is a hydraulic jack, and including a pump for hydraulic fluid for operation of said hydraulic jack, said hydraulic pump being located within said vertical column.

11. A football goal post of claim 10 including a control device for controlling the operation of said hydraulic jack from a site remote from said football goal post.

12. A football goal post of claim 11 wherein said control device can transmit control signals for operating said hydraulic jack to elevate or lower said main boom.

13. A football goal post of claim 11 dimensioned so that said hydraulic jack can raise said crossbar to a height of at least fifteen feet.

* * * * *